US009547279B2

(12) United States Patent
Rombach

(10) Patent No.: US 9,547,279 B2
(45) Date of Patent: Jan. 17, 2017

(54) CALENDAR DISPLAY DEVICE FOR A TIMEPIECE

(71) Applicant: ETA SA Manufacture Horlogere Suisse, Grenchen (CH)

(72) Inventor: Stefan Rombach, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/962,603

(22) Filed: Dec. 8, 2015

(65) Prior Publication Data

US 2016/0187853 A1 Jun. 30, 2016

(30) Foreign Application Priority Data

Dec. 30, 2014 (EP) ..... 14200609

(51) Int. Cl.
*G04B 19/247* (2006.01)

(52) U.S. Cl.
CPC ..... *G04B 19/247* (2013.01)

(58) Field of Classification Search
CPC ..... G04B 19/04; G04B 19/06; G04B 19/247; G04B 19/24306; G04B 19/046; G04B 19/20; G04B 19/202
See application file for complete search history.

(56) References Cited

U.S. PATENT DOCUMENTS 359,227 A * 3/1887 Pallweber ..... G04B 19/202 235/134
2,287,679 A * 6/1942 Greenawalt ..... G04B 19/202 235/113
6,842,404 B2 * 1/2005 Haselberger ..... G04C 17/005 368/223
7,433,272 B2 * 10/2008 Watanabe ..... G04B 19/24 368/35

(Continued)

FOREIGN PATENT DOCUMENTS

EP 1 536 300 A1 6/2005
EP 1 609 028 A2 12/2005

(Continued)

OTHER PUBLICATIONS

European Search Report issued Aug. 24, 2015 in European Application 14200609.7 filed on Dec. 30, 2014 (with English translation).

*Primary Examiner* — Sean Kayes
(74) *Attorney, Agent, or Firm* — Oblon, McClelland, Maier & Neustadt, L.L.P.

(57) ABSTRACT

Grand date calendar display device for a watch movement comprising a first disc and a second disc, arranged to display, on certain dates, first date values by combining symbols borne by said first disc and symbols borne by said second disc, and on other dates, second date values by symbols borne only by said second disc. The first disc is a modified units display disc, bearing a first series of symbols comprising a first sequence of at most nine first consecutive units numerals truncated by at least a second units numeral with (Continued)

respect to the complete series of ten units, and the second disc is a modified tens display disc including a second series of symbols for the display of at least the tens of the date, comprising at least one combination of two numerals formed of a tens numeral and a second units numeral.

11 Claims, 16 Drawing Sheets

(56) References Cited

U.S. PATENT DOCUMENTS

| | | | | |
|---|---|---|---|---|
| 7,457,202 | B2 * | 11/2008 | Takahashi | G04B 19/25333 368/28 |
| 7,889,602 | B2 * | 2/2011 | Behling | G04B 19/247 116/298 |
| 2005/0111302 | A1 | 5/2005 | Willemin et al. | |
| 2006/0028918 | A1 | 2/2006 | Groothuis et al. | |
| 2006/0098535 | A1 | 5/2006 | Marki et al. | |
| 2012/0213037 | A1 | 8/2012 | Schmidt | |
| 2013/0329531 | A1 * | 12/2013 | Nguyen | G04B 19/202 368/37 |

FOREIGN PATENT DOCUMENTS

| | | | |
|---|---|---|---|
| EP | 2 490 083 | A1 | 8/2012 |
| WO | WO 2004/088435 | A2 | 10/2004 |
| WO | WO 2004/114027 | A2 | 12/2004 |

* cited by examiner

CALENDAR DISPLAY DEVICE FOR A TIMEPIECE

This application claims priority from European Patent Application No. 14200609.7 filed Dec. 30, 2014, the entire disclosure of which is hereby incorporated herein by reference.

FIELD OF THE INVENTION

The present invention concerns a calendar display mechanism, and in particular a "grand date" calendar display mechanism.

BACKGROUND OF THE INVENTION

Conventional calendar display devices for timepieces, and in particular wearable wristwatches, usually use an annular date-disc including 31 regularly distributed annular sectors, each of the sectors including an indication corresponding to one of possible dates of the month. The date-disc is indexed one position every day, so as to reveal through an aperture the date value corresponding to each day, which is formed of one or more numerals. The angular sector occupied by each indexing position is thus relatively limited (360/31 i.e. slightly less than 12 degrees), which greatly restricts the maximum size of the numbers that can be displayed therein.

In order to increase the size of the indications displayed in the aperture for reading the date, there therefore exist systems using two distinct discs, one for the display of the tens numeral and the other for the display of the units numeral of the date. This type of calendar display combining two numerals borne by two distinct discs is referred to as a "grand date" display. These display devices are coupled to a control device for respectively indexing each of the discs in order to display every day the exact combination of units and tens.

There is known, for example, a "grand date" display mechanism including a units ring comprising the units sequence 0-9, and a tens disc including a sequence of four numerals 0-3 distributed over sectors of approximately 90° each, like that described in EP Patent No 2490083. A date programme wheel with 31 sectors, driven at the rate of one step per day, meshes on two separate planes, respectively with a tens disc and a units ring, to respectively drive the units disc every day, except on the change from the 31st day of the month to the first day of the following month, by means of 30 teeth followed by a toothless sector—the 31st of the date programme wheel—and the tens disc is only driven 4 times per month for the change to the next ten and the change of month (9→10, 19-20, 29-30 and 31-<01) by means of long teeth respectively arranged on the 9th, $19^{th}$, 29th and 31st sectors of the 31 gear sectors of the programme wheel, and which drives a cross integral in rotation with the tens wheel. One drawback of this type of calendar mechanism is that it requires a very large number of parts, which are separate for the control and display mechanism, and therefore occupy too much space on the plate. Further, the cross associated with the tens disc has a very small number of teeth, which is detrimental to gearing reliability due to the large angular steps required during each indexing operation.

Other types of "grand date" display mechanisms are also known, for example from EP Patent No 1609028, using a combined solution with a modified tens disc that can sometimes contain two numerals for certain dates. The fact that the modified tens disc bears a larger number of symbols certainly facilitates the gearing mechanism, but because the sequence of indications relating to the units is arranged on a disc integral in rotation with a programme wheel having 31 sectors, the maximum size of the characters that can be displayed consequently still remains very limited.

BRIEF SUMMARY OF THE INVENTION

It is an object of the present invention to provide a calendar display mechanism that is free of these known limitations.

It is another object of the present invention to provide a new type of grand date calendar display mechanism by combining two discs for at least some dates, using original sequences of display indications.

These objects are achieved in particular as a result of the features of a grand date calendar display device according to the main claim, and in particular a first modified units display disc, bearing a first series of indications comprising a first sequence of at most nine first consecutive units numerals, the first series of symbols being truncated by at least a second units numeral with respect to the complete series of ten units, combined with a second modified tens display disc including a second series of symbols for the display of at least the tens of the date, comprising at least one combination of two numerals formed of a tens numeral and a second units numeral.

Specific embodiments of the invention are defined in the dependent claims.

One advantage of the present invention is that it improves the balance of the indications borne by the two wheels, by moving some of the units indications to a modified tens disc. According to a preferred embodiment, the number of display indications borne by each of the wheels is exactly the same, which means that the size of the characters can be best adjusted for a combined display.

Another advantage of the proposed solution is that it employs a units disc, removing the need to use the complete sequence of numerals from 0 to 9 that has been used until now, by instead increasing the minimum sequence of indications borne by a modified tens disc, thereby facilitating and rendering more reliable each indexing of the latter.

According to a preferred embodiment, the two display discs are formed by rotating elements of substantially annular shape, i.e. whose display symbols cover a complete annular segment extending over 360 degrees during one cycle, typically of one month. When the indications of the two discs are arranged to cover the same annular surface and are superposed on each other for at least some dates, the display is confined in a small space and the control mechanism may even advantageously be incorporated at the centre of the ring for increased compactness.

BRIEF DESCRIPTION OF THE DRAWINGS

Advantageous example implementations of the invention are given by way of non-limiting example in the description and illustrated in the annexed Figures, in which.

the series of FIGS. 5A, 5B, 5C, 5D, 5E, 5F illustrate various views to explain the indexing mechanism of the first and second disc according to a preferred embodiment, during a first sequence for dates where the units are comprised between 2 and 9.

the series of FIGS. 6A, 6B, 6C, 6D, 6E, 6F and 6G illustrate various views to explain the indexing mechanism of the first and second disc according to a preferred embodiment, during a second sequence for the change of date to the next ten (9→10,19→20,29→30).

the series of FIGS. 7A,7B,7C,7D,7E,7F illustrate various views to explain the indexing mechanism of the first and second disc according to a preferred embodiment during a third sequence for the change from a whole ten to the next date ending in 1 (10→11, 20→21, 30→31).

the series of FIGS. 8A,8B,8C,8D,8E,8F illustrate various views to explain the indexing mechanism of the first and second disc according to a preferred embodiment during a fourth sequence for the change from dates ending in 1 to dates ending in 2 (01→02, 11→12, 21→22).

finally, the series of FIGS. 9A, 9B, 9C, 9D, 9E, 9F and 9G illustrate various views to explain the indexing mechanism of the first and second disc according to a preferred embodiment, during a fifth sequence for the change from the last (31st) day of the month to the 1st day of the next month (31→01).

EXAMPLE EMBODIMENT(S) OF THE INVENTION

Figure 1A:
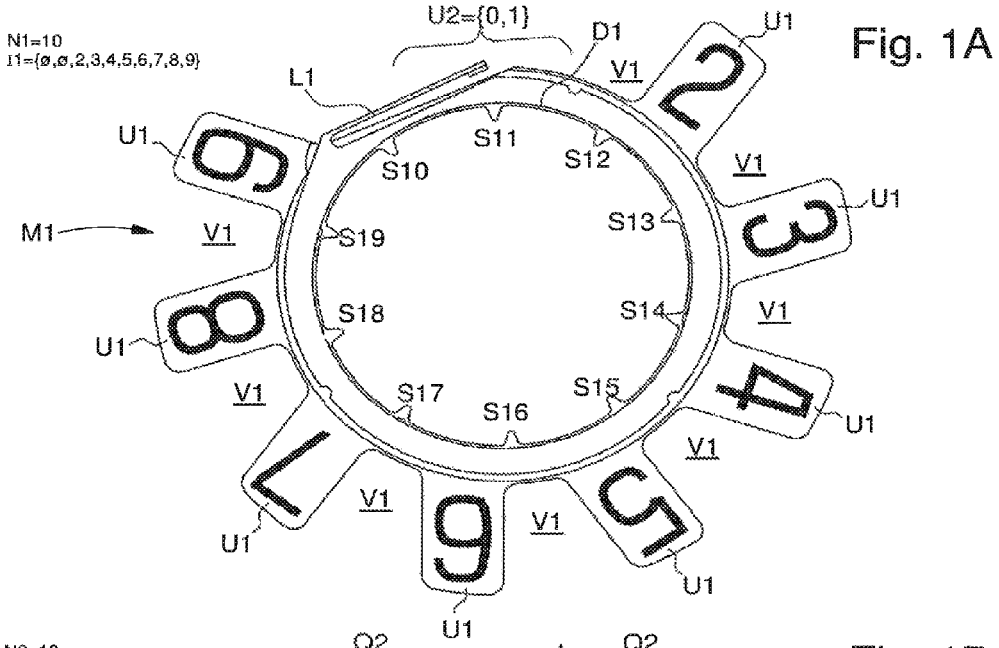
FIGS. 1A and 1B respectively illustrate a first modified units disc and a second modified tens disc.
Figure 1B:
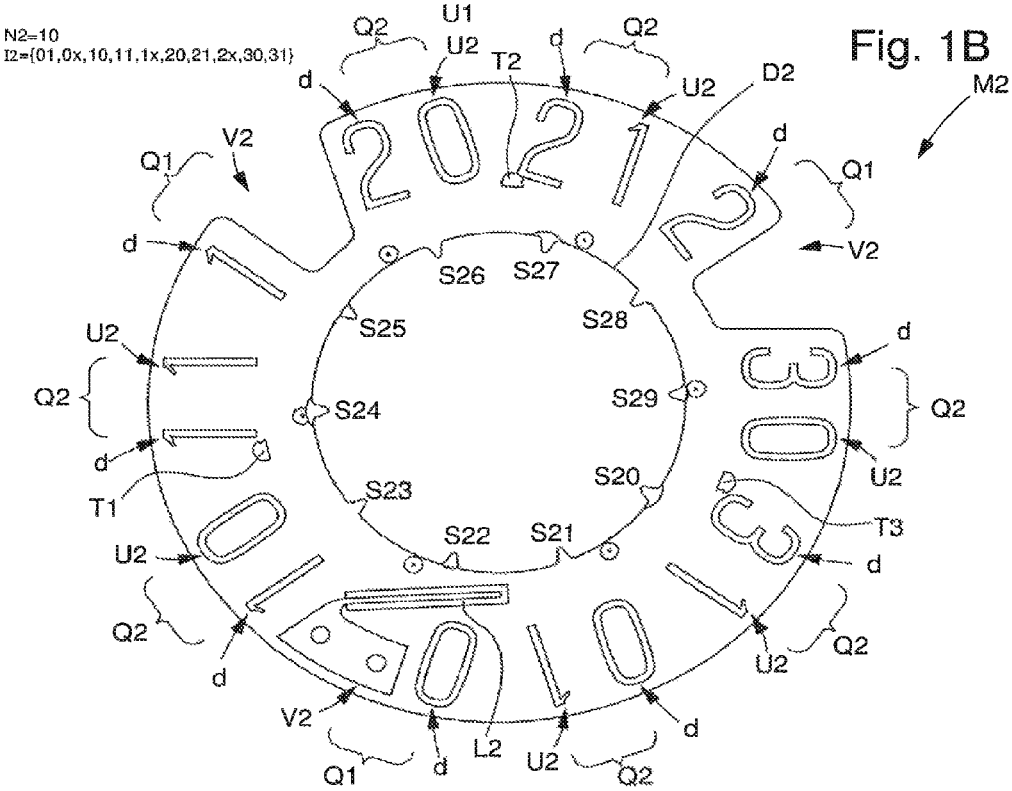

FIGS. 1A and 1B respectively illustrate two discs used for the grand date display according to a preferred embodiment of the invention.

The first disc M1 of FIG. 1A consists of a units disc provided in a conventional manner with 10 display segments respectively referenced S10, S11, S12, S13, S14, S15, S16, S17, S18 and S19, regularly spaced at the periphery of first disc M1, each corresponding to one of the numerals of the series from 0-9 but in which certain numbers have been truncated, here the numbers {0, 1}. The first disc M1 therefore bears a first series of symbols I1 which consists of a first space, a second space, followed by a first sequence U1 of first units numerals u1={2,3,4,5,6,7,8,9}. The first series of symbols I1={Ø, Ø, 2-9} thus contains ten display symbols, including 8 units numerals 2-9 and the two spaces Ø correspond to a second sequence U2 of second units numerals u2, here the numeral 0 and the numeral 1, the display of which is moved to a second series of symbols placed on second disc M2, as seen in FIG. 1B. All the symbols i1 of the first series I1 are separated from each other by a first recess v1, so as to facilitate the display by combining with a tens numeral d on at least some dates, which will be termed the "first dates" Q1.

The second disc M2 of FIG. 1B is a modified tens disc, which, in addition to bearing the symbols of the 4 conventional tens numerals d (0, 1, 2, 3) can also display dates ending in the truncated units of first disc M1, i.e. 0 and 1. This second disc M2 must consequently be able to display the dates 01, 10, 11, 20, 21, 30 and 31 without needing to be combined with first disc M1, and these seven aforecited date values are referred to as "second dates" Q2, i.e. date values entirely displayed by second disc M2, as opposed to first dates Q1 which are displayed by combining symbols of first disc M1 with symbols of second disc M2.

The second disc M2 of FIG. 1B is also provided with 10 display segments referenced S20,S21,S22,S23,S24,S25, S26,S27,S28 and S29, regularly spaced at the periphery thereof, and with a second series of symbols I2={01,0X,10, 11,1X,20,21,2X,30 and 31}—the value "X" indicating a second recess v2 or any number value, provided that a corresponding symbol of the first series I1 of the first disc can be entirely superposed thereon—comprising a number of symbols equal to that of first disc M1, and to the number of display segments, i.e. 10. Such an arrangement is particularly advantageous for the insertion of a control device with superposed gear sectors, which allows for significant space saving, particularly when each of the two display discs M1, M2 has a substantially annular shape, i.e. wherein the geometric shape obtained by scanning all the symbols during one display cycle corresponds to a ring, freeing space at the centre thereof for insertion of a control mechanism. The first display disc M1 and the second display disc M1 can otherwise advantageously be arranged in the form of concentric rings. The first disc M1 is provided with a first main toothing D1 arranged to mesh with a drive wheel and pinion, such as, typically, a 24-hour drive wheel R, illustrated below in FIG. 1C, as is second disc M2, which includes a second main toothing D2 for meshing with said same drive wheel R.

FIG. 1A shows the presence of a first leaf L1, at the display segments referenced S10-S11 corresponding to the truncated units. As will be seen below, the function of this first leaf is to act as an element for driving second disc M2 via first disc M1 during the indexing of certain dates, notably the change of the tens as a result of cooperation respectively with a first post T1, a second post T2 and a third post T3 integral with second disc M2, seen in FIG. 1B. It will be understood that the positioning of this first leaf L1 depends on the relative angular position of the posts, and it does not necessarily have to be arranged in the aforecited angular sectors; the advantage of the preferred illustrated embodiment is simply to separate the display of the first series of symbols L1 of the first disc M1 of the drive device from the second disc, which increases clarity. Similarly, FIG. 1B shows the presence of a second leaf L2, provided, vice versa, for driving first disc M1 via second disc M2 during the indexing of certain other dates, particularly the change from dates ending in the number "1" to those ending in "2", as a result of cooperation with notches provided on the inner perimeter of the first disc M1, that is to say:

a first notch E1 for the change 01→02, a second notch E2 for the change 11→12, and finally a third notch E3 for the change 21→22.

These three notches E1, E2, E3 and their relative position with respect to second leaf L2 are visible in the series of FIGS. 5 to 9 relating to the five indexing sequences characteristic of the preferred control mechanism for implementing the display device according to the invention, detailed below.

As can be seen with reference to FIGS. 1A and 1B, the illustrated preferred embodiment is particularly advantageous since each of the first and second discs uses exactly the same number of display symbols, i.e. the number of first symbols i1 of the first series of symbols I1 of first disc M1 is identical to the number of second symbols i2 of the second series of symbols I2 of the second disc M2, and both are equal to 10. These two series of symbols are also distributed over the same number of display segments, which means that none of the symbols is repeated more than once during each cycle, which makes it possible to maximise the size of each display segment and thereby the size of the displayed numerals. There is therefore a situation wherein the first number N1 of first display segments of first disc M1 is equal to the second number N2 of second display segments of second disc M2, which facilitates the gearing mechanism, and wherein the size of each numeral or each space borne by each disc can also have an optimal size: it will be noted in fact that the sizes of the first and second recesses v1, v2, of the tens numeral d, and of the first and second units numerals u1-u2 can all be identical, both in terms of size and the space occupied on the angular sector which makes the display particularly homogeneous and reliable for indexing.

Nonetheless, although in the following description a mechanism for programming display discs will be described in detail using this advantageous arrangement, it will be understood that it is possible, without departing from the scope of the present invention, to transfer the display of as many units as wished to the tens disc, the number of symbols and display segments of the modified units disc then being increased accordingly. Thus, if instead of only truncating the units numerals 0 and 1 of the first series of symbols I1 of the first modified units disc, a second sequence U2 of second numerals {0,1,2} of first disc M1 were truncated, it would then be possible to envisage using a second modified tens disc M2 bearing a second series of symbols I2 {01,02,0X, 10,11,12,1X, 20,21,22,2X,30,31}. It is observed that the number of symbols of the second series of symbols increases threefold for each additional truncated unit—here a total of 13—which requires adjustment of the gearing mechanism by the corresponding ratio between the first number of first segments N1 of first disc M1 and the second number of second segments N2 of second disc M2, namely 10/13 if the number of first segments N1 remains at 10. It is also possible to reduce the number of truncated units to only one, namely the single unit {0}, and similarly reduce the second series of symbols I2 to the following seven symbols {0x, 10, 1x, 20, 2x, 30,3x}, by adjusting the gearing ratios between the two discs M1, M2 accordingly.

According to a preferred embodiment using the control mechanism described below, the second sequence of units U2 of second truncated units numerals u2 of the first disc nonetheless always starts with the numeral "0", and is completed by the following consecutive numerals, in order to follow a particularly advantageous precise indexing sequence. It should be noted in this regard that it is possible to modify first units disc M1 by adding a symbol "1" to the display segment referenced S11 of first disc M1 without changing disc M2 or the proposed programming mechanism for indexing dates on a monthly cycle from 1 to 31, and it is also possible to modify first units disc M1 by removing the first unit u1 of value "2" from the first display segment referenced S12, and at the same time modifying each of the display segments respectively referenced S22, S25 and S28 by adding the second unit u2 equal to 2 in place of second recesses v2 visible in FIG. 1B, and embodied by notches at the places where there is no second leaf L2.

Figure 1C:
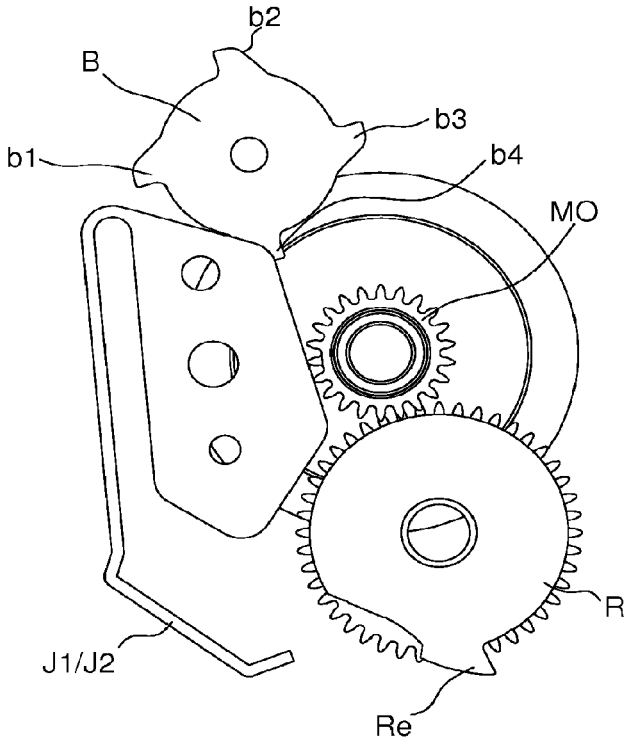
FIGS. 1C and 1D illustrate other constituent parts used by the grand date display device according to a preferred embodiment of the invention.

FIG. 1C illustrates a top view of a drive mechanism intended to be incorporated inside the free space at the centre of the two display discs M1, M2 according to the preferred embodiment proposed. There is seen the canon-pinion of the movement M0, which drives, by means of a suitable gear ratio, a 24-hour drive wheel R so that the latter completes exactly one revolution each day. This drive wheel also includes a daily gear sector Re in which are preferably arranged two teeth of identical profile in two different gear planes, namely first daily gear tooth Rd1 and second daily gear tooth Rd2—visible in FIGS. 3A and 3B—intended to mesh respectively with the first main toothing D1 of first disc M1, and the second main toothing D2 of second disc M2. A corrector wheel set B, commonly called a "sliding pinion", includes a series of 4 correction teeth—first correction tooth b1, second correction tooth b2, third correction tooth b3 and fourth correction tooth b4—spaced at 90° from each other, in order to provide good gear safety and to move sufficiently fast when activated, for example by means of a crown. These teeth of the sliding pinion are respectively intended to drive with a first additional toothing D1' of first disc M1, and a second additional toothing D2' of second disc M2, located in separate gear planes from those of the main toothings, as illustrated below with reference to the pairs of FIGS. 3A-3B and 4A, 4B. Sliding pinion B may be situated in any angular sector inside the free space at the centre of the display rings of first disc M1 and of second disc M2 other than that occupied by the 24-hour drive wheel R, which leaves great flexibility of arrangement among the 9 possible positions corresponding to the remaining angular sectors. The additional toothings may thus be obtained by a simple circular permutation with respect to the main toothings. The diametrically opposed position of sliding pinion B and 24-hour drive wheel R is thus for a particular case, but this configuration is not essential to accomplish the invention.

Figure 3A:
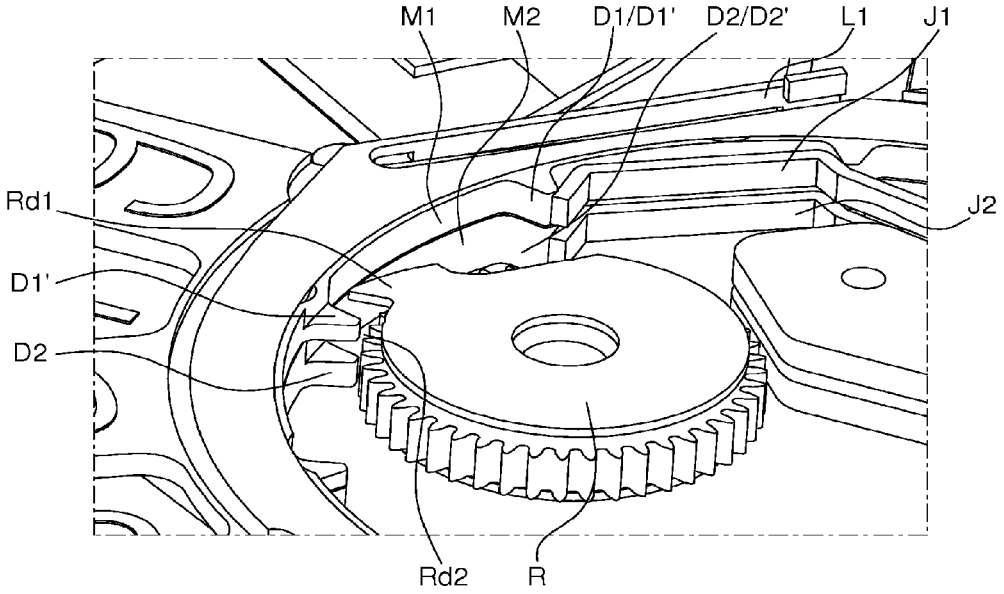
FIGS. 3A and 3B respectively illustrate a three-dimensional view of the mechanism for gearing the various toothings of the first and second disc with the 24-hour drive wheel, and a sectional view of the various gearing planes of each of these toothings, for the example of the change from the 31st day of the month to the 1st day of the following month, according to a preferred embodiment of the grand date display device of the invention.

In order to hold first disc M1 and second disc M2 in indexed positions, there is provided respectively a first jumper J1 and a second jumper J2, which are superposed but separate from each other, as seen in FIG. 3A below; they are arranged on a given display segment and are inserted between two teeth of the toothings of each disc. The thickness of each jumper is preferably extended on the main and additional gear planes of each disc, so that it is possible to hold each disc in an indexed position, i.e. first disc M1 and second disc M2, in the proposed configuration with a 24-hour drive wheel R and a sliding pinion B diametrically opposite each other, since the jumper of each disc (J1 for M1, and J2 for M2) will always be positioned in abutment, between two consecutive display segments, on at least a first tooth of a main or additional gear plane of said disc and a second tooth of a main or additional gear plane of said disc. In other words, the main and additional toothings of each disc never simultaneously present two consecutive toothless gear sectors with this arrangement of 24-hour drive wheel R and sliding pinion B.

Figure 1D:
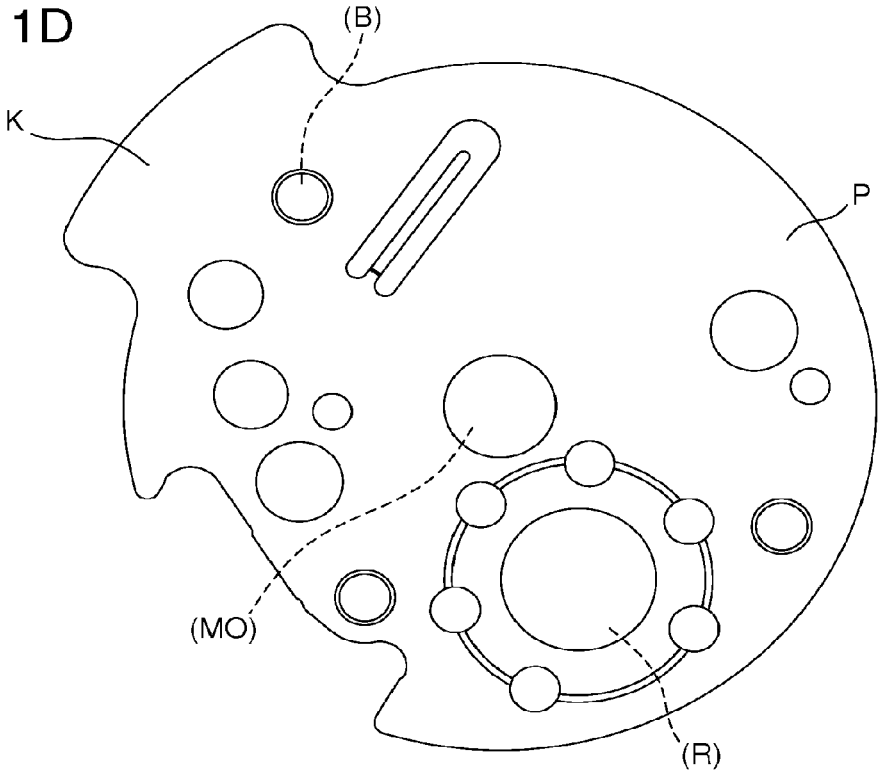

FIG. 1D shows a preferred version of a holding plate P for the drive elements illustrated in FIG. 1C described above. Arrows are shown in dotted lines pointing to the axes of sliding pinion B, of canon pinion M0, and of 24-hour drive wheel R. According to this preferred embodiment, holding plate P contains a fixed gear sector K extending substantially over the width of one display segment and which is intended, as will be seen below with the aid of the gear sequence illustrated in the FIG. 6 series, to allow the date to change to the next ten by means of a coupling element preferably formed by a flexible leaf of the same type as first leaf L1 illustrated in FIG. 1A.

Figure 2A:
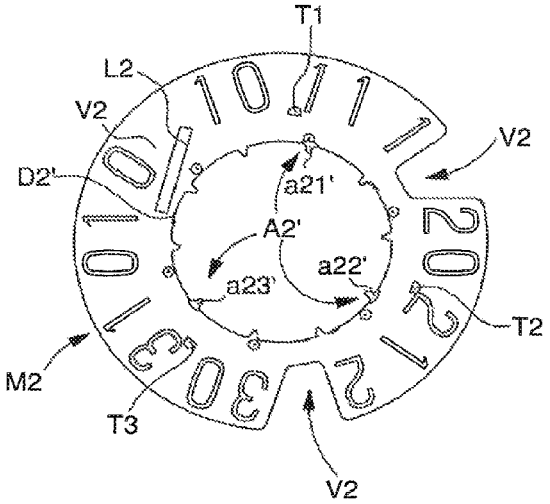
FIGS. 2A, 2B, 2C and 2D respectively illustrate top and bottom views of the first and second disc of FIGS. 1A and 1B, showing various mutual coupling elements in addition to the various toothings acting in distinct gearing planes to daily drive the calendar mechanism and correct the date in a preferred embodiment of the grand date display device according to the invention.
Figure 2C:
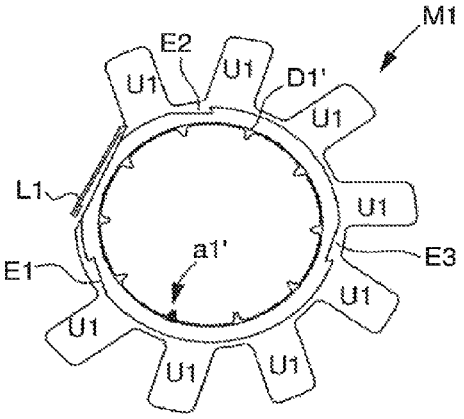
Figure 2B:
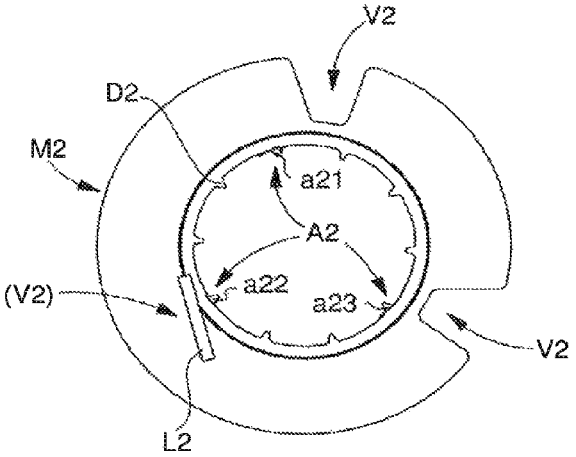
Figure 2D:
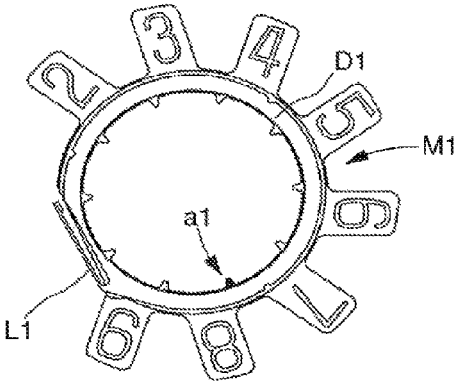

FIGS. 2A and 2B respectively illustrate top and bottom views of second disc M2 of FIG. 1B, whereas FIGS. 2C and 2D conversely illustrate bottom and top views of first disc M1 of FIG. 1A. FIG. 2A again shows the second sequence of symbols I2 {01,0X,10,11,1X,20,21,2X,30,31}, with the second recesses v2 clearly visible for the symbols 1X, and 2X, embodied by notches, whereas a last second recess v2 is located at symbol 0X, where the second leaf L2 for driving first disc M1 is arranged. These notches are seen again in FIG. 2B, in addition to the position of second leaf L2 by axial symmetry on a horizontal axis with respect to FIG. 2B. Although a similar inner toothing of second disc M2 can be seen in FIGS. 2A and 2B, in reality these toothings correspond to a main toothing and an additional toothing, intended to mesh with different wheels in different planes. Thus, in FIG. 2A, the toothing shown corresponds to the second additional toothing D2' of second disc M2, which meshes with sliding pinion B in a second additional plane P2', whereas the toothing shown in FIG. 2B corresponds to the second main toothing D2 of second disc M2, meshing with 24-hour drive wheel R in a second main plane P2. Each of the second main and additional toothings D2 and D2' respectively has a series referenced A2 and A2' of toothless sectors respectively in second main plane P2 and second additional plane P2'. These series of toothless sectors are arranged to allow the indexing of first disc M1 by causing the first sequence U1 of first units numerals u1, namely here 2-9, to pass in turn facing each of the sectors on which are arranged the second recesses v2 for a combined display, whereas second disc M2 remains in place. Each of these two series referenced A2 and A2' respectively include three toothless sectors, which are determined from each other by circular permutation according to the relative position of arrangement of 24-hour drive wheel R with respect to that of sliding pinion B. The angular position of the gear segments of second disc M2 is defined according to the position of the aperture on the dial and the position of 24-hour drive wheel R, such that each of the toothless sectors is located opposite the drive wheel when the second recesses v2 of the wheel of the second disc are displayed in the aperture. According to the preferred embodiment that is described and illustrated, as will be noted with reference to the series of FIGS. 5 to 9 illustrating the various indexing sequences, the display aperture is at 9 o'clock on the dial, and the 24-hour drive wheel and sliding pinion are respectively arranged approximately at 5 o'clock and 11 o'clock on the plate. The toothless sectors of each of the wheels have been annotated in FIGS. 2A and 2B to reflect this configuration, comprising:

- a first toothless sector in main gear plane P2 of second disc M2 referenced a21, placed in display segment S29 of FIG. 1B, beneath the display symbol "30";
- a second toothless sector in main gear plane P2 of second disc M2 referenced a22, placed in display segment S22 of FIG. 1B, beneath the display symbol "0X";
- a third toothless sector in main gear plane P2 of second disc M2 referenced a22, and placed in display segment S25 of FIG. 1B, beneath the display symbol "1X".

Similarly, the series of toothless sectors in the additional gear plane of second disc M2 includes:

- a first toothless sector in additional gear plane P2' of second disc M2 referenced a21', placed in display segment S24 of FIG. 1B, just beneath the display symbol "11";
- a second toothless sector in additional gear plane P2' of second disc M2 referenced a22', placed in display segment S27 of FIG. 1B, just beneath the display symbol "21"; and finally
- a third toothless sector in additional gear plane P2' of second disc M2 referenced a23', placed in display segment S20 of FIG. 1B, just beneath the display symbol "31".

These two series of toothless sectors A2 and A2' are moreover visible in FIG. 1B, although not referenced for reasons of clarity, with the aid respectively of small and medium arcs of a circle facing the toothless sectors of the second main toothing D2 and the second additional toothing D2' of second disc M2.

Figure 3B:
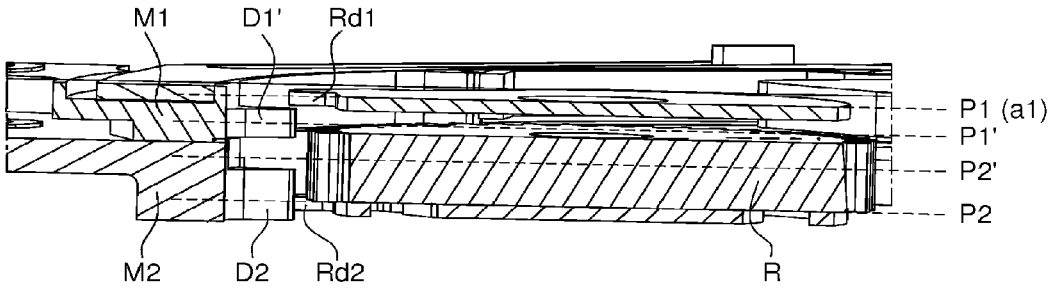
Figure 4A:
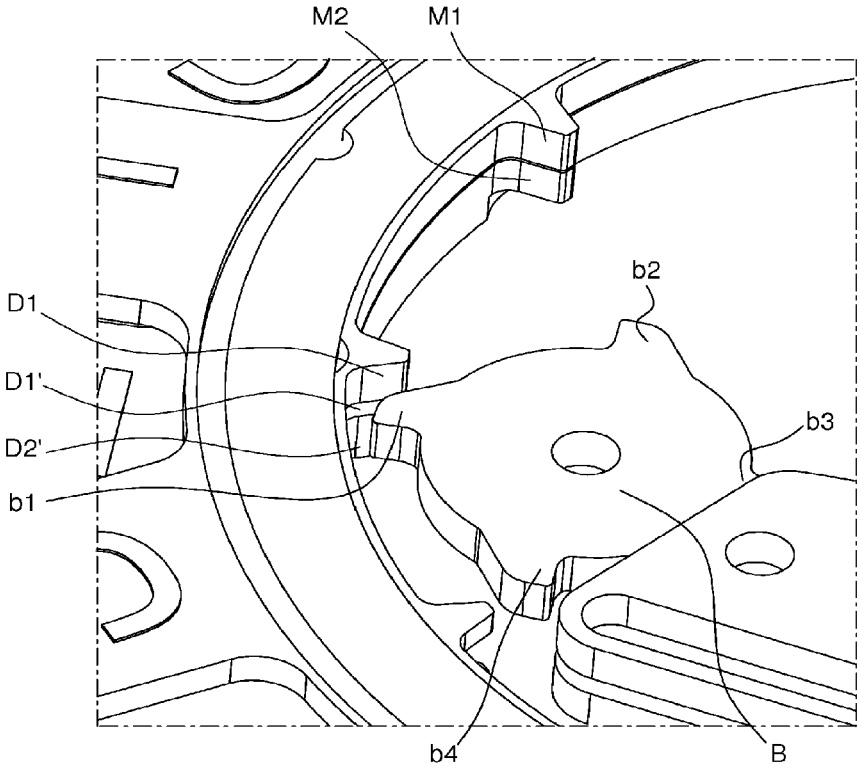
FIGS. 4A and 4B respectively illustrate a three-dimensional view of the mechanism for gearing the various toothings of the first and second disc with the sliding pinion, and a sectional view of the various gearing planes of each of these toothings, for the example of the change from the 31st day of the month to the 1st day of the following month, according to a preferred embodiment of the grand date display device of the invention.
Figure 4B:
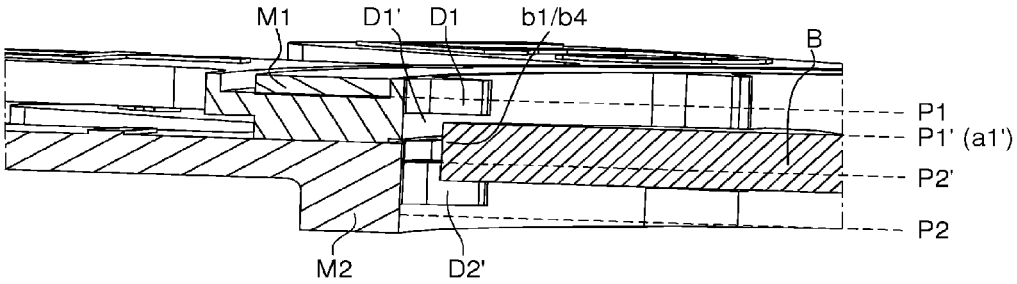

All the main and additional gear planes P1, P2, P1' and P2' are illustrated in FIGS. 3B and 4B below. In FIG. 2A, there is also seen the first drive post T1 of the first ten for the change from the 9th to the 10th day of the month, the second drive post of the second ten for the change from the 19th to the 20th day of the month, and finally the third drive post T3, for the change from the 29th to the 30th day of the month. The angular position of the drive posts depends on the relative position of the aperture, of fixed gear sector K, and the first leaf L1 on which the fixed gear sector acts to drive in rotation second disc M2; the proposed configuration thus corresponds to that of a gear sector positioned at approximately 11 o'clock, and of a first leaf 1 arranged on the display segments corresponding to those of the truncated units {0,1} for a display aperture arranged at 9 o'clock on the dial; it will be understood however from the foregoing that other arrangements are possible without departing from the scope of the invention.

FIGS. 2C and 2D respectively show a bottom and top view of the first units disc M1 in which there is seen, in addition to first sequence U2 of the first numerals u1 of units 2-9, also a first leaf L1 for driving second disc M2 with the aid of posts T1, T2, T3 described above, which are integral with the second disc, and in accordance with the same principle as in FIGS. 2A and 2B above, a main and additional toothing intended to mesh in separate planes with 24-hour drive wheel R for a daily gear, and with sliding pinion B for manual correction of the date on demand. In FIG. 2D, the first main toothing D1 is identical to that shown in FIG. 1A with 10 equally distributed display segments, intended to mesh in a main plane P1 with 24-hour drive wheel R. In this gear plane, there is seen a toothless sector referenced a1, shown in black in contrast to the 9 other toothless sectors, which is intended to allow indexing of the second disc while leaving the first disc M1 stationary. According to the preferred embodiment described, this type of indexing is essential to change from the 31st day of one month to the first day of the next month. Similarly, in FIG. 2C, the first additional toothing D1' is intended to mesh in a first additional plane P1 with sliding pinion B, and there is a corresponding toothless sector a1', also shown in black in contrast to the other 9 toothless sectors.

Referring to the series of FIGS. 2A, 2B, 2C and 2D, it will be noted that the position of the toothless sectors corresponding to each distinct gear plane for the same disc can be deduced by axial symmetry with respect to a vertical axis, since the top and bottom views are symmetrical on a horizontal axis, and the arrangement of the two drive wheel sets, namely drive wheel R and sliding pinion B are arranged symmetrically with respect to the centre of the plate of the movement. The composition of an axial symmetry and a central symmetry actually consists of an axial symmetry on an axis orthogonal to the preceding one.

FIG. 2C also shows a last drive element for allowing the mutual coupling between the first and second disc, namely notches E1, E2 and E3, which are intended to cooperate with second leaf L2 to drive first disc M1 via second disc M2. First disc M1 includes three notches on its inner periphery, arranged for driving dates ending in "1" to dates ending in "2" according to the preferred embodiment described. More specifically, first notch E1, second notch E2 and third notch E3 are distributed over a cycle of 10 equally distributed segments, first notch E1 and third notch E2 being separated by 3 segments, second notch E2 and third notch E3 also being separated by 3 segments, and consequently third notch E3 and first notch E1 are separated by 4 segments. The positioning of this series of notches depends on the positioning of second leaf L2 on second disc M2 and also on that of the display aperture on the dial. According to the preferred embodiment described, where second leaf L2 is positioned on display segment S22 of the figure of FIG. 1B, corresponding to the symbol "0X", first notch E1 must be configured to drive the first disc M1 during the change from the 1st day of the month to the 2nd, so that second leaf L2 then cooperates with second notch E2 for the change of date from the 11th to the 12th, and finally with the third notch E3 for the change of date from the 21st to the 22nd. Thus, during the change from the 31st day of the month to the 1st of the following month, second leaf L2 will be offset by one segment with respect to first notch E1 and in this configuration, due to the missing teeth in the first disc—the toothless sector referenced a1—unlike the other dates ending in "1" above, the first disc M1 will not be driven by the second disc to complete the 31 day cycle of the month. This gear mechanism is explained with reference to the illustrations of the following series of FIGS. 8 and 9, which explain in detail respectively the fourth indexing sequence for the change from dates ending in 1 (1st, 11th, 21st) to the next dates ending in 2 (2nd, 12th, 22nd) and the fifth gear sequence corresponding to the particular case of the change from the 31st to the 1st.

FIGS. 3A and 3B respectively illustrate a three-dimensional view of the gearing mechanism of the various toothings of the first and of the second disc with the 24-hour drive wheel and, in particular, the first main toothing D1 meshing in the first main gear plane P1 and the second main toothing D2 meshing in the second main gear plane. The sectional view of FIG. 3B shows the particular arrangement of all the gear planes, including the additional gear planes of each disc, respectively referenced P1' for the first disc and P2' for the second disc, with each of the drive toothings at the change from the 31st day of the month to the 1st day of the following month. According to the preferred embodiment of the grand date display device of the invention described here, the first main toothing D1 of the first disc is intended to have a toothless sector a1, whereas the main toothing D2 of the second disc has a tooth. Consequently, the first gear tooth Rd1 of drive wheel R in the first main plane P1 does not drive first disc M1, while the second gear tooth Rd2 of drive wheel R meshes in the second main plane P2 with a tooth of toothing D2 of the second disc. In FIG. 3A, it is seen that the first additional toothing D1' also has no teeth in this gear sector, which makes it possible to clearly separate the different gear planes, which follow each other in the following order from top to bottom: P1, P1', P2', P2, clearly visible in FIG. 3B. It is to be noted, however, in the same FIG. 3A, that the adjacent gear sector situated above has a homogenous toothing D1, D1' and D2, D2' with teeth that extend respectively over the entire depth of first disc M1, and that of second disc M2. It is over this depth that each retaining jumper can extend, respectively first jumper J1 for the first disc and second jumper J2 for the second disc. This arrangement of discs with display segments and gear toothings completely superposed on the inner perimeter of annular-shaped parts for the first and second discs (M1, M2) consequently not only saves space, but also considerably simplifies implementation of the mechanism for programming the date display.

Similarly, FIGS. 4A and 4B illustrate a three-dimensional view of the mechanism for gearing the various toothings of the first and second disc with the sliding pinion, and particularly the additional toothings for the same example of the change from the 31st day of the month to the 1st day of the following month. As explained above, the sliding pinion does not mesh in the first and second main gear planes P1, P2 of each disc, but in first and second additional gear planes P1', P2', which are juxtaposed and respectively sandwiched between the first and second main gear planes P1, P2, which allows the sliding pinion to be arranged with a certain depth combining the drive toothings of the two discs, thereby obviating the need to machine two separate toothings in two separate planes having the same profile, as for drive wheel R, which reduces production costs. Whatever the position of sliding pinion B on the plate, it must be ensured that the sliding pinion can mesh, by means of one of its four teeth b1-b4 (in FIG. 4A, it will be the second tooth b2 when sliding pinion B is activated) with a tooth profile that is identical, on the additional gear toothings, to the tooth with which 24-hour drive wheel R meshes at the same time on the main toothings. Thus, it is to be noted in FIG. 4B, that there must be one toothless sector—referenced a1'—on the first additional toothing D1' in the first additional gear plane P1', since there was a toothless sector referenced a1 on the first main toothing D1 in the first main gear plane P1 (see FIG. 3B); similarly there will be a tooth on second additional toothing D2' for this gear sector in second additional gear plane P2', since there was one on the second main toothing D2 in the second main gear plane P2 (see FIGS. 3B and 4B for comparison).

It will be understood from the example described above, corresponding to the fifth gear sequence described below with reference to the series of FIG. 9, in connection with the series of FIG. 2 described above, that each of the first and second discs M1, M2 respectively has a first and a second main daily gear toothing D1, D2 that meshes selectively with a 24-hour drive wheel R according to the date, as a function of whether or not a tooth is present. Drive wheel R thus forms the starting point of a first kinematic chain for driving first disc M1, and also the starting point of a second kinematic chain for driving second disc M2. The various toothings thus form a programming mechanism for each of their respective drive operations.

This drive mechanism via separate kinematic chains for each of the discs is then completed, within the scope of the present invention, by a mutual bidirectional coupling mechanism between the first and the second disc on certain dates.

The mechanism for coupling first disc M1 to second disc M2 is thus formed, according to the preferred embodiment described, by driving the posts (respectively first, second and third posts T1, T2, T3) by means of first leaf L1 three times during a 31-day month cycle, first leaf L1 being integral with the first disc M1 comprising 10 display segments and consequently having a more limited cycle of a maximum of 10 indexed positions. A coupled position of leaf L1 is determined by a fixed gear sector K arranged on the plate, which extends over at least the width of one display segment and must at least make it possible to drive the second disc for the change to the next ten, that is to say the change from the 9th to the 10th day of the month, from the 19th to the 20th day of the month, and from the 29th to the 30th day of the month.

The mechanism for coupling second disc M2 to first disc M1 consists, according to the preferred embodiment described, in driving positioned notches (respectively first, second and third notches E1, E2, E3) by means of a second leaf L2, integral with second disc M2, and arranged obliquely towards the inner perimeter of first disc M1. According to the preferred embodiment described, the presence of three notches spaced in a defined manner, (cycle of 3/3/4 over 10 equidistant angular segments) is necessary to allow the measuring from the 1st to the 2nd, then from the 11th to the 12th, and finally from the 21st to the 22nd and then to stop the driving on the last day of the month (31st), even though this date also ends in the unit numeral "1".

In the series of FIGS. 5 to 9 which follow, there will be described 5 essential indexing sequences in the preferred embodiment using first disc M1 and second disc M2 illustrated in FIGS. 1A and 1B, and the 10-segment programming mechanism for each of these discs. These series of Figures are intended to show the relative angular positions of the two discs in relation to each other, and the positions of the mutual coupling elements, namely here first leaf L1 with respect to each of posts T1, T2, T3 and respectively second leaf L2 with respect to each of notches E1, E2, E3 in relation to each other. To facilitate the reader's understanding, the symbols of the first disc M1 are shown in solid characters, in order to distinguish them from those of the second disc M2 and to make it possible intuitively to see whether the display is of a first date Q1 or of a second date Q2.

Each of FIGS. 5A, 6A, 7A, 8A and 9A and respectively 5D, 6D, 7D, 8D and 9D show the current date displayed through an aperture made in a dial C, and which is formed here by a first window F1 for the display of the tens numeral d and a second window F2 for the display of the units number, respectively before and after an indexing step. The dates displayed through the aperture correspond either to a first date Q1, when the first numeral u1 is displayed using symbols borne by the first disc M1, or to a second date Q2, when the units numeral is a second units numeral u2 truncated from first disc M1, namely here "0" or "1", and therefore borne by second disc M2.

Figure 5A:
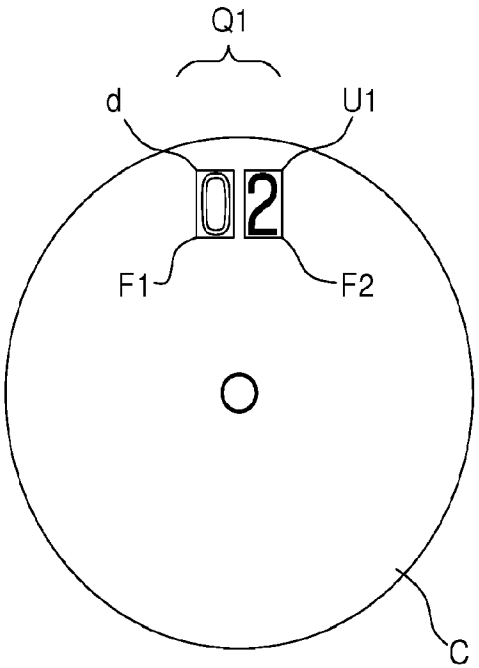
FIGS. 5A, 5B and 5C respectively illustrate the date through an aperture in the dial, and the relative positions of the first and second discs, seen from above and from below, for the 2nd day of the month.

The series of FIG. 5, namely FIGS. 5A, 5B, 5C, 5D, 5E and 5F illustrate a first indexing sequence for date values whose units are comprised between 2 and 9, namely a total of 7 indexing steps for the change: 2-3, 3-4, 4-5, 5-6, 6-7, 7-8 and 8-9. This indexing sequence is repeated 3 times in one monthly cycle, with the units numeral "d" which may be equal either to 0, or to 1, or to 2. FIG. 5A illustrates the date "02" displayed through an aperture in dial C, before indexing, and FIGS. 5A and 5B respectively show the relative positions of the first and second discs M1, M2, in top and bottom views. In this position, the 24-hour drive wheel R faces the first toothless sector a21 of second toothing D2 of the second disc, seen in FIG. 5B, which is thus not driven in rotation, whereas the first toothing D1 of first disc M1 has one tooth to be driven by drive wheel R for each of the dates from 2 to 8. All the dates displayed during this sequence are first dates Q1 for which first units numerals u1 are visible in the second display window F2.

Figure 5B:
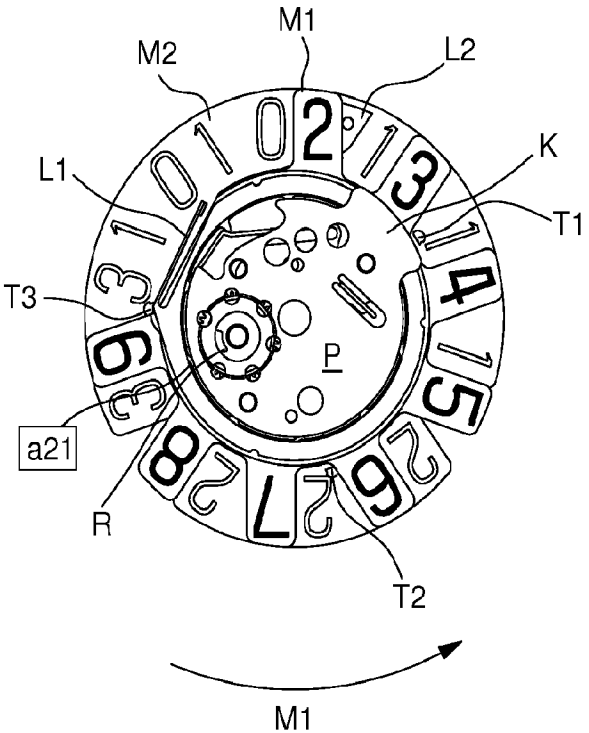
Figure 5C:
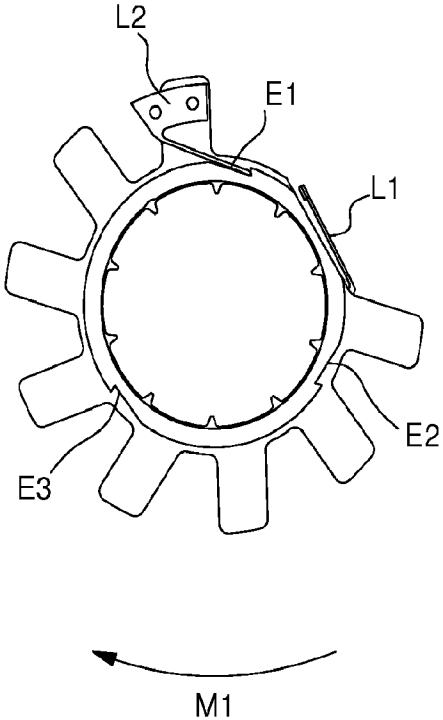
Figure 5D:
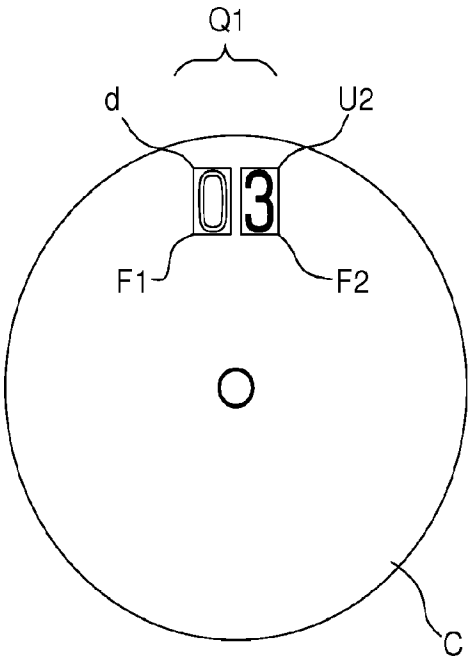
FIGS. 5D, 5E and 5F are the same views as FIGS. 5A, 5B and 5C above but following the change to the 3rd day of the month.
Figure 5E:
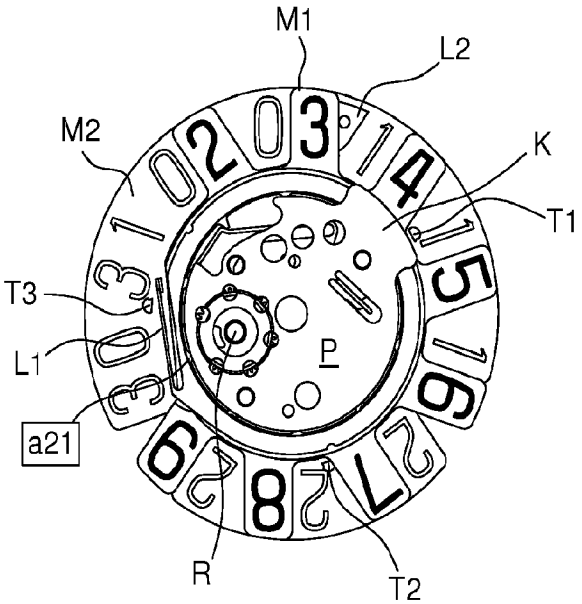
Figure 5F:
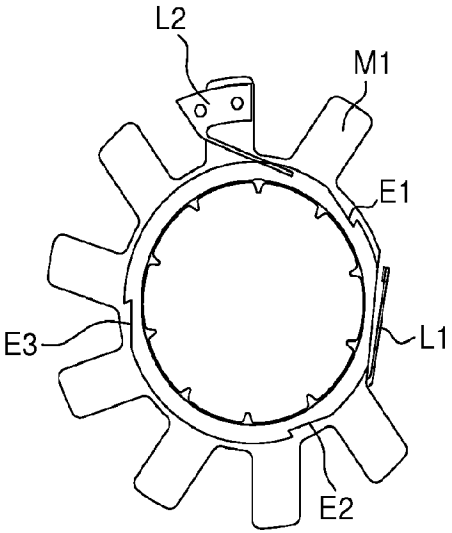

In FIG. 5B, it is seen that the second leaf L2 is located at the aperture, and more specifically the second display window, and in FIG. 5C, it is seen that this second leaf L2 engages with first notch E1. During each indexing of this first sequence, first disc 1 rotates in the direction of rotation indicated by the arrows seen in FIGS. 5B and 5C and the orientation of second leaf L2 and that of each of the notches, that is to say first notch E1, second notch E2, and third notch E3, allows first disc M1 to slide on this second elastic leaf L2. As can be observed in FIGS. 5E and 5F which show the same views as FIGS. 5B and 5C, after the change to the 3rd day of the month, second leaf L2 has remained in the same position, whereas first disc M1 has shifted by one display segment, so that second leaf L2 no longer engages with any of the notches. The 24-hour drive wheel R is still facing the first toothless sector a21 of second toothing D2 of the second disc. At the end of this first indexing sequence, i.e. for the 9th day of the month, second leaf L2 will no longer be engaged with first notch E1, but with third notch E2 at the end of the first cycle, and it will be understood that the relative position of the first and second discs M1, M2 will change from the engagement of second leaf L2 with second notch E2 for the 12th day of the month to engagement with third notch E3 for the 19th day of the month, and from engagement with third notch E3 for the 22nd day of the month to a position shifted by one display segment with respect to the first notch—as in FIG. 5F—for the 29th day of the month, to allow the last indexing of the fifth sequence from the 31st day of the month to the 1st of the following month explained with reference to the series of FIG. 9 below.

During this first indexing sequence, the fixed gear sector K of plate P has not been used, it will be used for the second indexing sequence illustrated in FIGS. 6A-G together with the first leaf L1 integral with first disc M1.

Figure 6A:
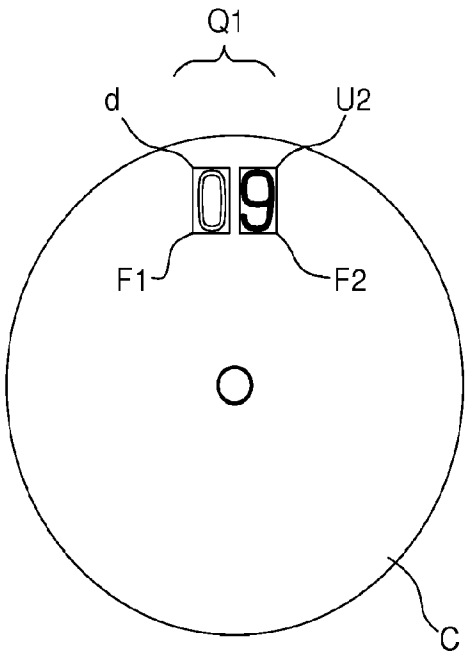
FIGS. 6A, 6B and 6C respectively illustrate the date through an aperture in the dial, and the relative positions of the first and second discs, seen from above and from below, for the 9th day of the month.
Figure 6B:
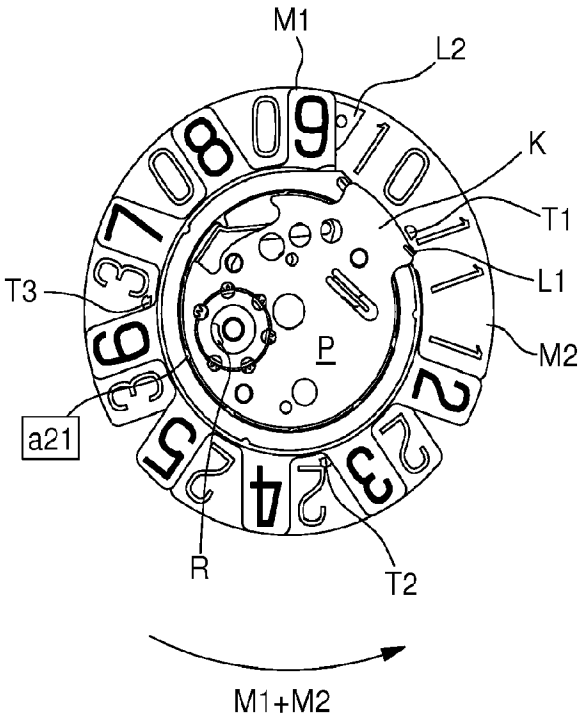
Figure 6C:
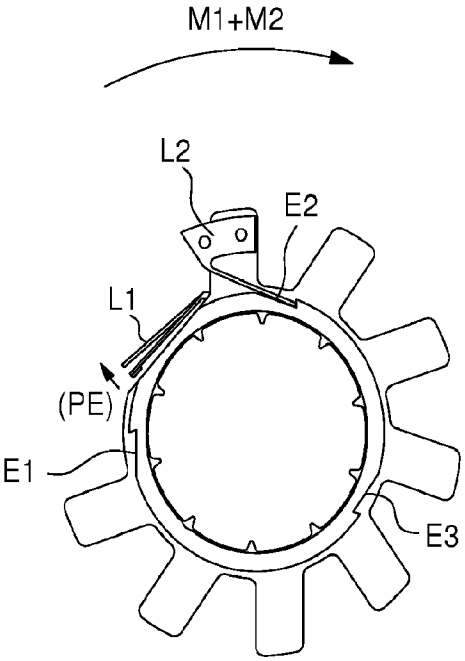
Figure 6D:
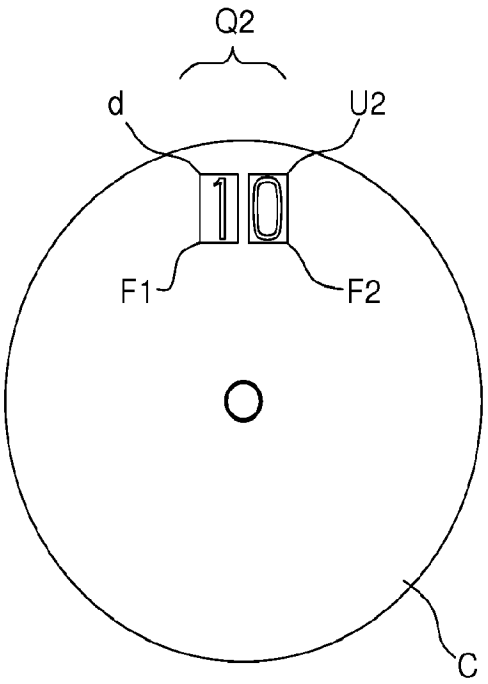
FIGS. 6D, 6E and 6F are the same views as FIGS. 6A, 6B and 6C above but following the change to the 10th day of the month.
Figure 6E:
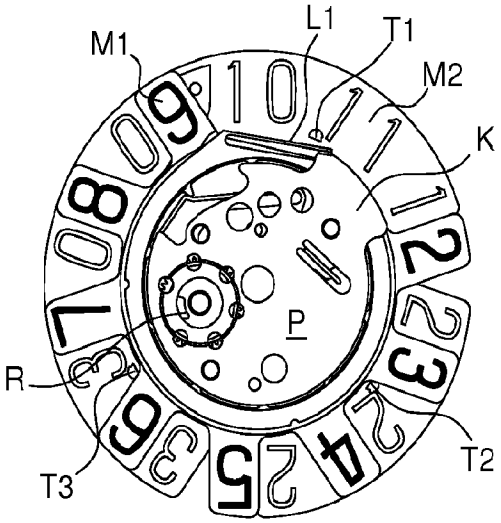
Figure 6F:
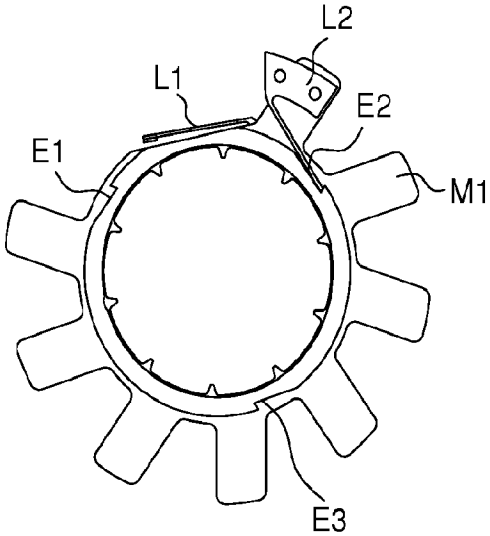

FIGS. 6A and 6D illustrate the change from a first date Q1—09 here—to a second date Q2—10 here. In fact, if the first tens numeral d is still displayed via second disc M2, the first units numeral u1 "9" is displayed by first disc M1 whereas there is a change to a second units numeral u2 "0" also displayed by the second disc M2.

Figure 6G:
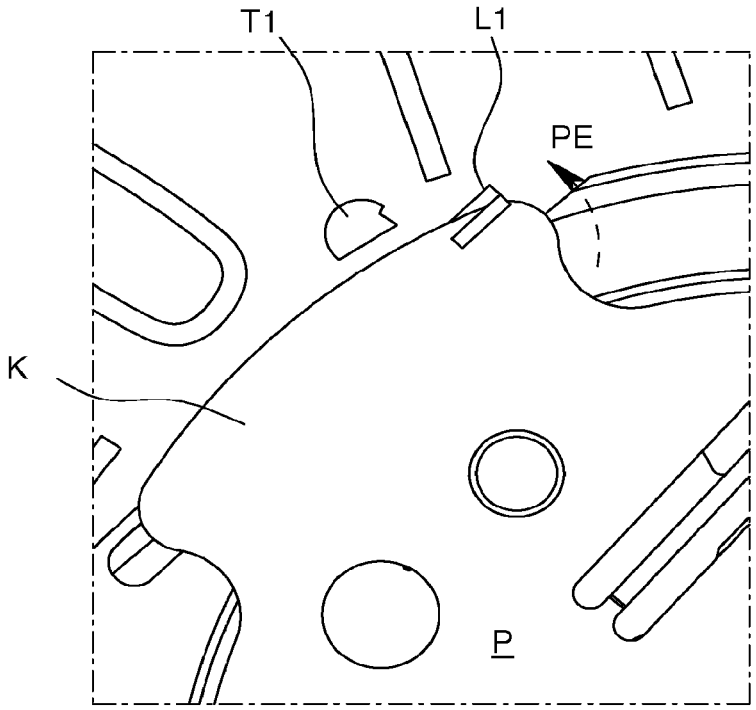
FIG. 6G illustrates a detailed view showing the gearing of a leaf of the first disc with a post of the second disc for the mutual driving thereof in rotation.

During this second indexing sequence, the two discs rotate together, since first disc M1 drives second disc M2. As can be seen in the detail of FIG. 6G, the first leaf L1 is pushed outwards into an active position by fixed gear sector K of holding plate P, i.e. the drive position referenced "PE" in FIG. 6G, so that it drives first post T for the change to the first ten. It will be understood that there is a similar coupling mechanism for each tens change, using the same gear sector K, but which will respectively push first leaf L1 towards second post T2 to change from the 19th day of the month to the 20th, and towards third post T3 to change from the 29th day of the month to the 30th.

As can be seen in FIG. 6B, the second leaf L2 is still positioned facing the aperture whereas the last unit "9" of the first series of symbols I1 of first disc M1 is now facing second window F2. As explained above, and as can be observed in FIG. 6C, this second leaf L2 is now positioned in second notch E2. To overcome the first toothless sector of second disc M2, referenced a21, which is still facing 24-hour wheel R, and therefore is not driving second disc M2 in rotation, whereas first disc M1 is driven via tooth on its first gear toothing D1 (not referenced in this Figure for reasons of legibility), the mechanism for coupling second disc M2 by first disc M1 via first post T1 driven by first leaf L1 makes it possible to drive second disc M2 and first disc M1 jointly in rotation by one display segment in the direction of rotation indicated in FIGS. 6B and 6C. Indeed, it can be observed in FIGS. 6E and 6F that second leaf L2 is still facing second notch E2, but that it is shifted by one display segment (downwards in FIG. 6E which is a top view, and upwards in FIG. 6F which is a bottom view).

Figure 7A:
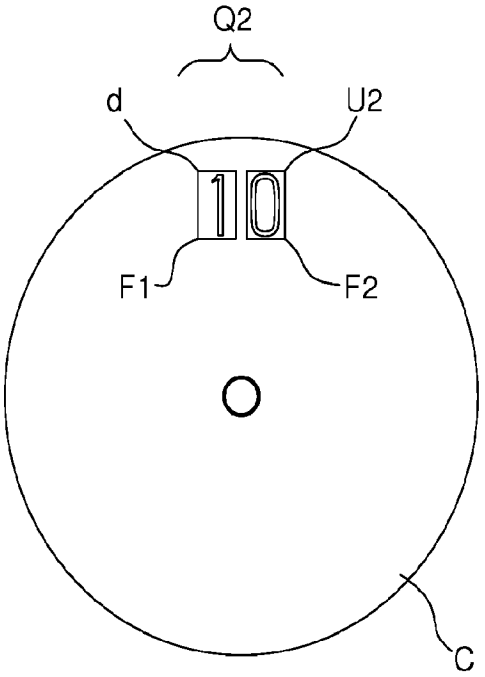
FIGS. 7A, 7B and 7C respectively illustrate the date through an aperture in the dial, and the relative positions of the first and second discs, seen from above and from below, for the 10th day of the month.
Figure 7B:
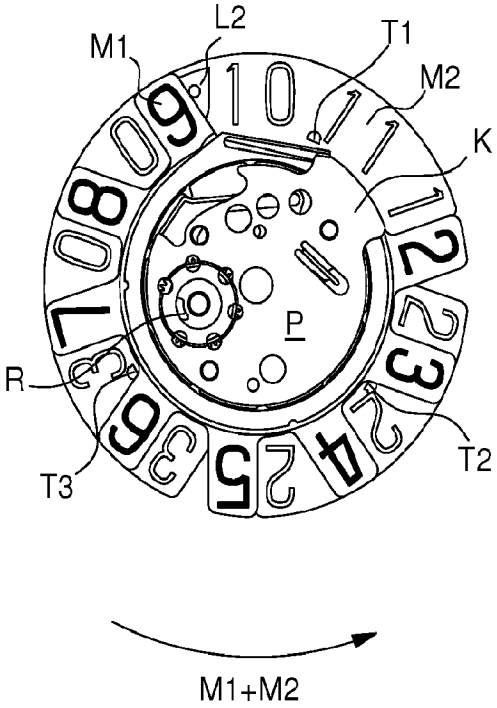
Figure 7C:
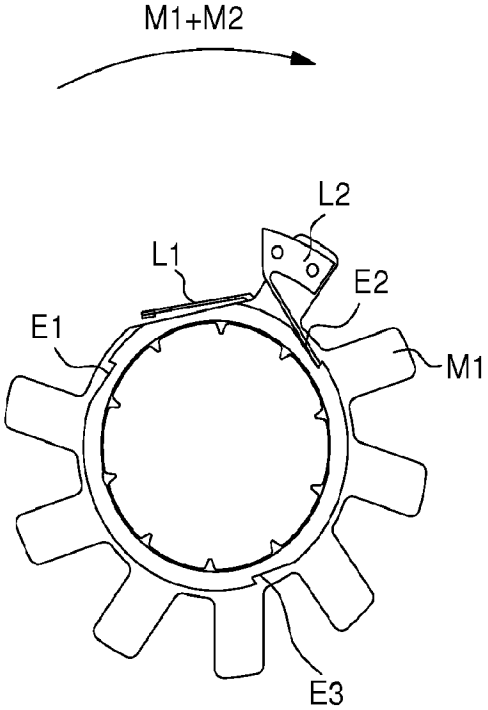
Figure 7D:
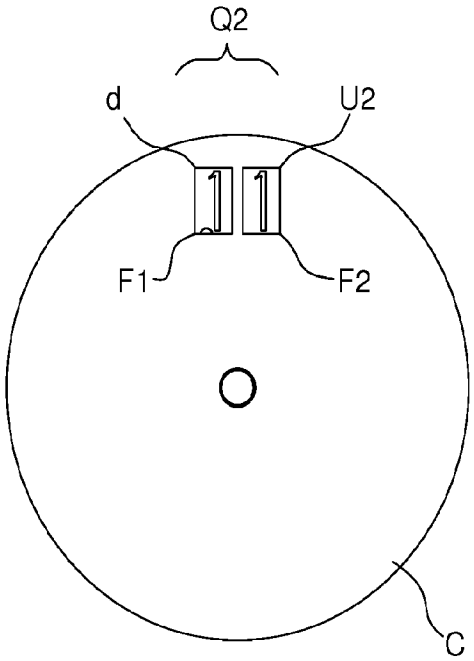
FIGS. 7D, 7E and 7F are the same views as FIGS. 7A, 7B and 7C above but following the change to the 11th day of the month.
Figure 7E:
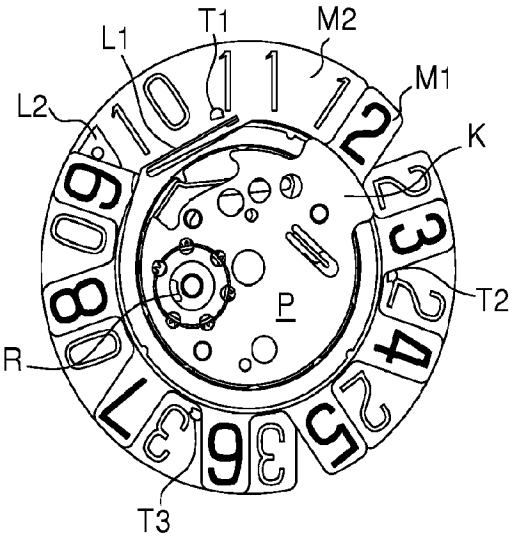
Figure 7F:
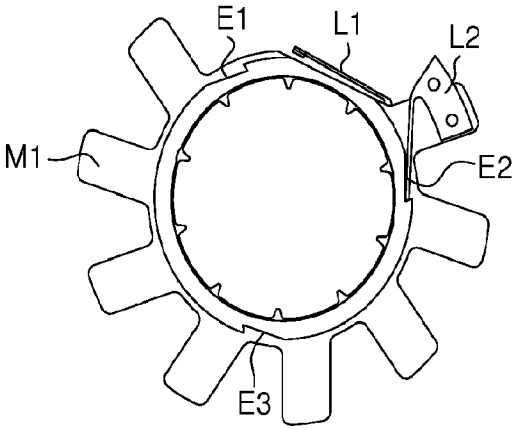

The third sequence illustrated by the series of FIGS. 7A to 7F shows the change from a second date Q2 to another second date, since this is a change from a date ending in "0" to a date ending in "1", and each of these two numerals are truncated second numerals u2 from the first series of symbols I1. According to the preferred embodiment described here, the mode of driving the first and second discs M1 and M2 is very simple, since the first main toothing D1 of first disc M1 and the second main toothing D2 of second disc M2 each contain a tooth that meshes with drive wheel R, so that no coupling mechanism is necessary. It will be understood, however, that according to an alternative embodiment, the fixed gear sector K could be enlarged so that the first leaf L1 is still pushed outwards in this position in order still to drive first post T1, so that no tooth is required on second main toothing D2 of second disc M2 to drive the latter, since it will in that case be driven by coupling to first disc M1. Further, given that the second leaf L2 is still positioned in second notch E2 in this position, one tooth could be removed from this location on first main toothing D1 and first disc M1 could be driven, in that case, by second disc M2. Similar reasoning applies for the change of dates 20-21 where first leaf L1 could still drive second post T2, or alternatively second leaf L2 could still drive first disc M1 by means of third notch E3; for the change of dates 30-31, it would be first leaf L1 that could still drive third post T3, however, with second leaf L2, no alternative would be possible for driving first disc M1, since the leaf will be shifted by one display segment with respect to first notch E1, as in the fifth sequence, illustrated by the series of FIGS. 9A-F explained below. FIGS. 7B and 7C, which respectively show a top and bottom view, illustrate the relative positions of the first and second discs M1 and M2, with the direction of rotation of both discs which rotate simultaneously during indexing. For these alternative embodiments (not illustrated), it will be understood that the first and second additional toothings D1' and D2' will be adjusted according to the profile of the modified first and second main toothings D1 and D2. FIGS. 7A and 7D show the indexed position of an additional display segment of each of the two discs M1, M2, with second leaf L2 which is still engaged with the second notch but now two display segments below the aperture formed by the first display window F1 and the second display window F2. For the change from the 20th to the 21st day of the month, the angular position of first disc M1 would remain unchanged, but the second leaf of second disc M2 would be positioned at approximately 3 o'clock on the dial, and in third notch E3, as though in FIG. 7F, only second leaf L2 had been moved to be placed in third notch E3. For the change from the 30th to the 31st, the position of the first disc M1 would be identical to that of FIGS. 7B/7C before indexing and 7E/7F after indexing, and the position of second disc M2 would be identical to that which it occupied in FIGS. 9B and 9C.

The fourth indexing sequence illustrated in FIGS. 8A-8F corresponds to the indexing of dates whose units end in "1" to dates whose units end in "2". In other words, there is a change from a second date Q2 displayed only by second disc M2, like date "11" seen in FIG. 8A, to a first date Q1 displayed in combination with first disc M1, like date "12" visible in FIG. 8D. For these dates, first disc M1 is positioned such that first toothing D1 has a toothless sector a1, referenced in FIG. 8B, in order to allow second disc M2 to be driven at the end of the month—for the date "31" which also ends in a "1"—without first disc M1, which is the subject of the fifth sequence illustrated by FIGS. 9A-9F below, and which therefore constitutes a particular case of the fourth sequence described below.

Figure 8A:
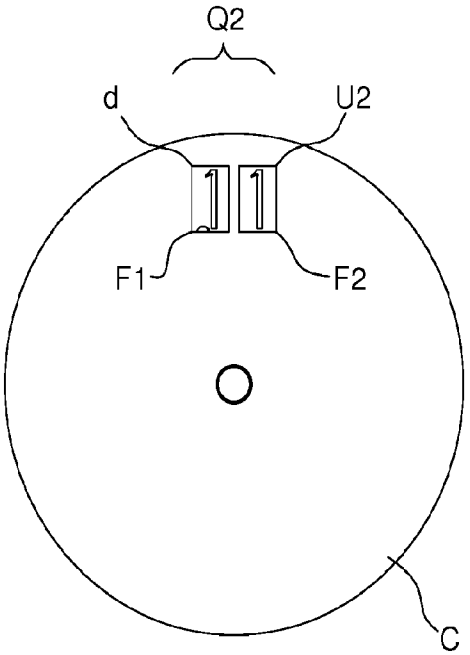
FIGS. 8A, 8B and 8C respectively illustrate the date through an aperture in the dial, and the relative positions of the first and second discs, seen from above and from below, for the 11th day of the month.
Figure 8B:
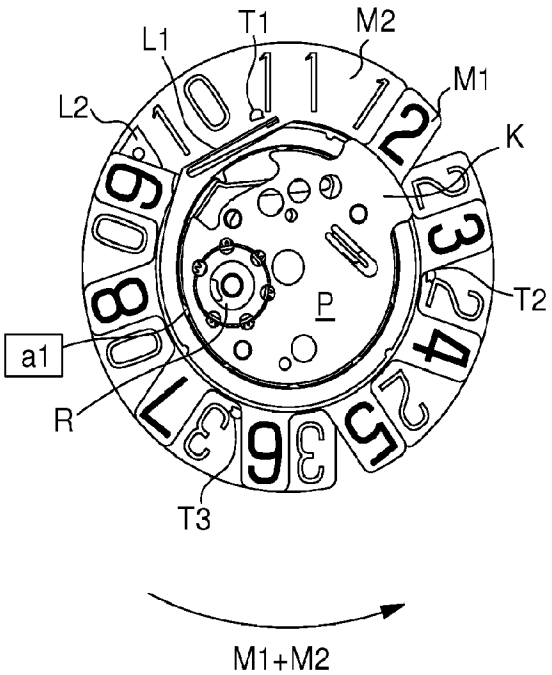
Figure 8C:
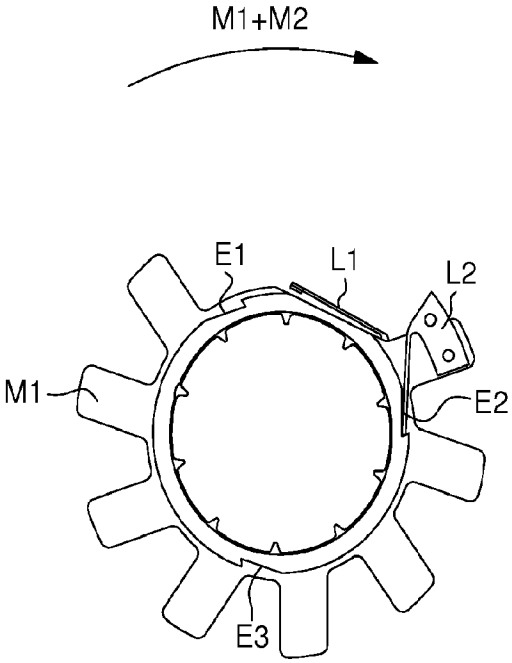
Figure 8D:
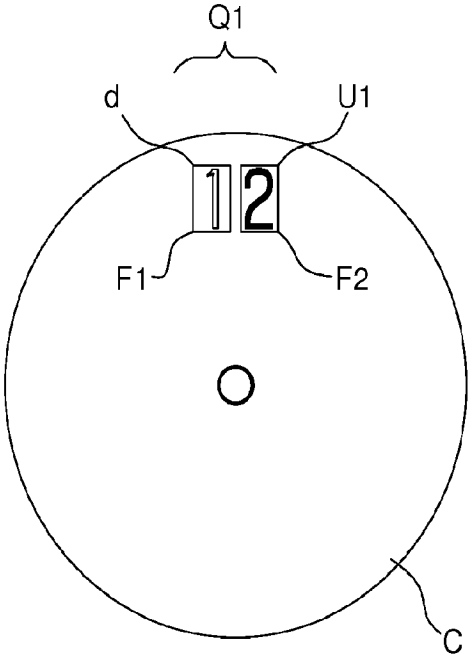
FIGS. 8D, 8E and 8F are the same views as FIGS. 8A, 8B and 8C above but following the change to the 12th day of the month.

For the 11th day of the month, second leaf L2 of second disc M2 engages in second notch E2 of the first disc, so that, even in the absence of teeth on the first main toothing D1 of first disc M1, the latter is driven in rotation by second disc M2, driven by 24-hour drive wheel R through an additional display segment in the direction of rotation indicated by the arrows in FIGS. 8B and 8C. The relative position of the two discs consequently remains unchanged between FIGS. 8B/C and 8E/F, since each of the discs has been rotated such that the first units numeral "2" of the first sequence U1 of first numerals u1 is displayed in the second window F2 of the aperture, whereas second leaf L2 is superposed on the display segment of the last numeral 9 of the first symbols of first disc M1, at substantially 6 o'clock on the dial. This sequence is repeated, like all the other preceding indexing sequences, three times each month, all that changes for indexing from the 1st to 2nd day of the month with respect to the illustrations of the series of FIGS. 8A-8F is the position of second leaf L2 which is engaged with first notch E1 instead of second notch E2, with the position of second leaf L2 changing from an angular position of approximately 10 o'clock on the dial to approximately 9 o'clock on the dial, facing the aperture at the end of indexing, as in FIGS. 5A/5B of the first indexing sequence described above, and to which the calendar mechanism will then return. For indexing from the 21st to the 22nd day of the month, second leaf L2 will engage with third notch E3, and the angular position of second leaf L2 will change from a substantially 3 o'clock position on the dial, to a 2 o'clock position on the dial.

Figure 8E:
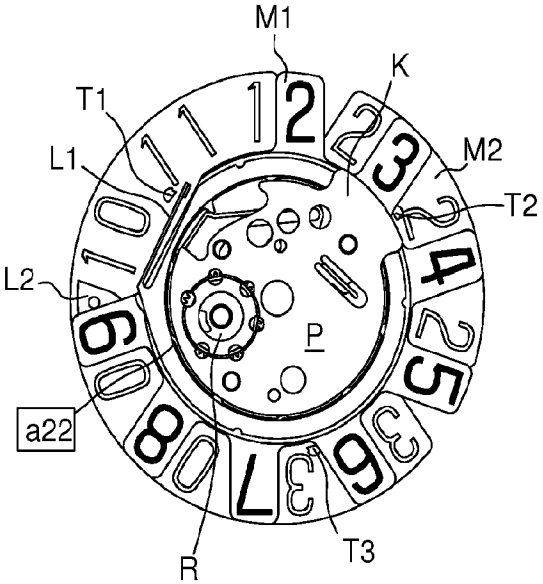
Figure 8F:
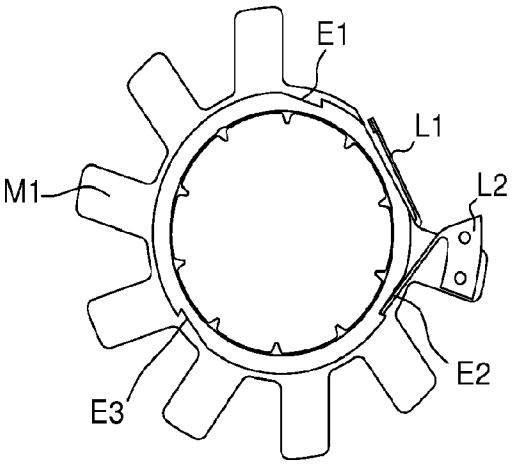

At the end of each of these three possible indexing steps for this fourth indexing sequence, it will be noted that drive wheel R changes from a display segment where first main toothing D1 of first disc M1 is provided with a first toothless sector a1, to the next display segment where the second toothing is provided with a toothless sector, namely: first toothless sector referenced a21 for the 2nd day of the month (see FIG. 5B), second toothless sector referenced a22 in FIG. 8E for the 12th day of the month and finally third toothless sector referenced a23 for the 22nd day of the month.

The series of FIGS. 9A-9F concern the fifth and last indexing sequence which, unlike the four indexing sequences previously described, is only performed once per month, whereas the other four are each performed three times. As explained above with reference to FIGS. 8A-F relating to the fourth indexing sequence, the fifth indexing sequence is a particular case of the fourth indexing sequence where the second disc M2 is driven only by one tooth of second main toothing D2, whereas the absence of teeth on first main toothing D1—toothless sector referenced a1 in FIG. 9B—and the absence of a coupling mechanism between the first and second display discs means that second disc M2 rotates alone, without first disc M1.

Figure 9A:
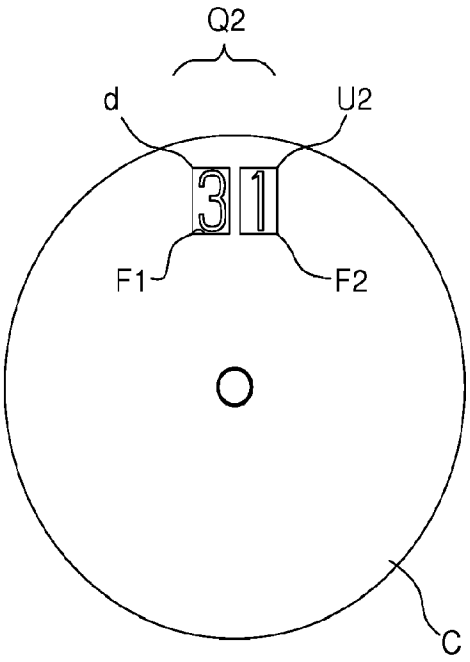
FIGS. 9A, 9B and 9C respectively illustrate the date through an aperture in the dial, and the relative positions of the first and second discs, seen from above and from below, for the 31st day of the month.
Figure 9B:
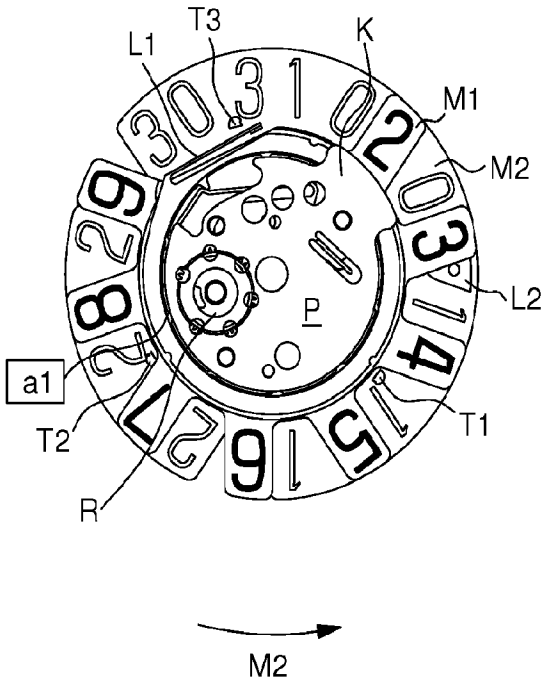
Figure 9C:
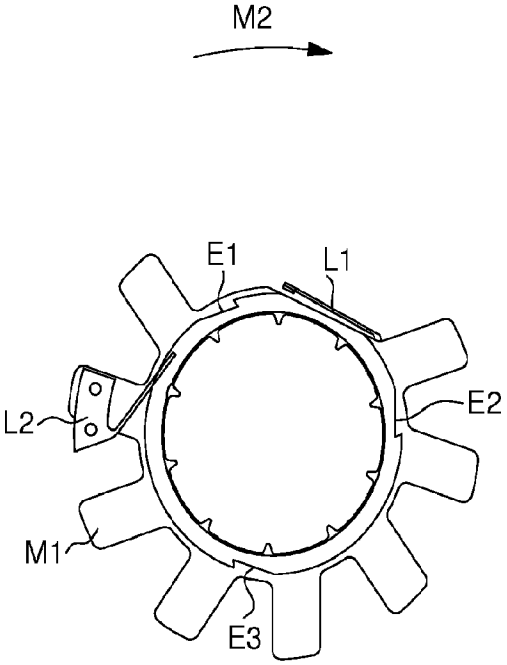
Figure 9D:
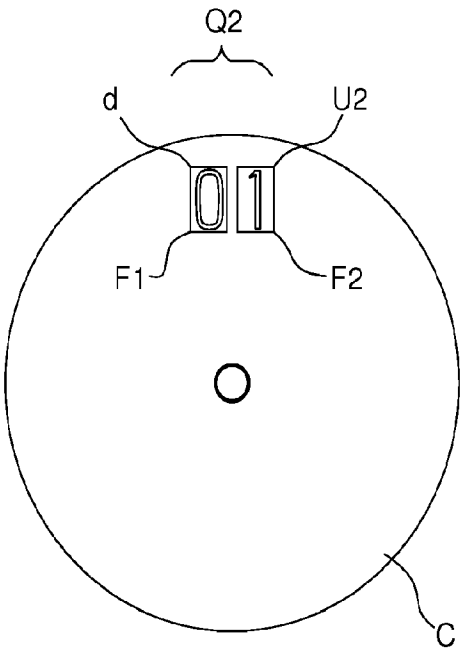
FIGS. 9D, 9E and 9F are the same views as FIGS. 9A, 9B and 9C above but following the change to the 1st day of the next month.
Figure 9E:
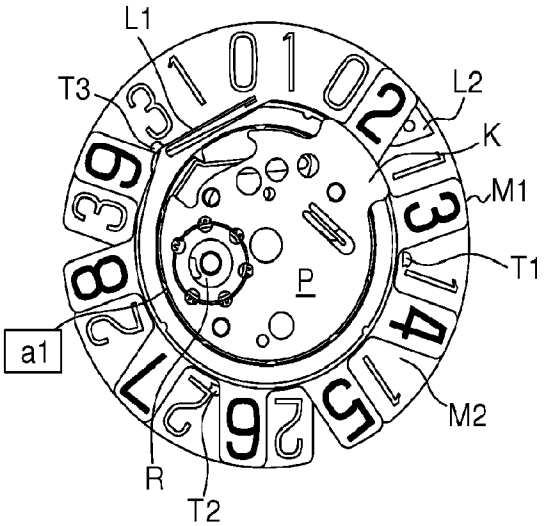
Figure 9F:
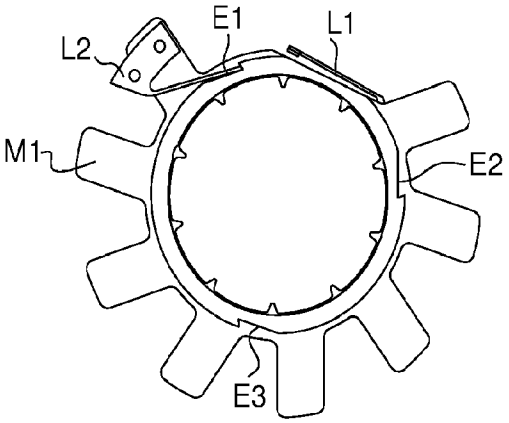

As can be observed by comparing FIGS. 9A and 9D, respectively showing the symbols before and after indexing from the 31st day to the 1st day of the next month, this sequence changes from a second date Q2 entirely displayed by second disc M2 to another second date Q2 still displayed by second disc M2. The angular position of first disc M1, seen in FIGS. 9B and 9C, does not change during indexing and is found again in FIGS. 9E and 9F. Consequently the same toothless sector referenced a1 is seen again in FIG. 9E. As can be observed in FIG. 9C, this is due to the fact that the relative angular position of first disc M1 with respect to second disc M2 is such that second leaf L2 is not engaged in first notch E1, so that any driving by mutual coupling is impossible. Second leaf L2 could still drive first disc M1 by means of first notch E1 once second disc M2 had rotated, and this mutual engagement L2/E1 can be checked in FIG. 9F after this fifth indexing sequence, which will then immediately allow indexing in the fourth indexing sequence described in the preceding paragraphs, followed by the first sequence etc.

Indeed, once this indexing has been accomplished, one entire display cycle is completed and the angular position of the two discs is identical with respect to the aperture, namely the second leaf and the first numeral "2" of the first sequence U1 of first units numerals u1 substantially located at 10 o'clock on the dial, namely the angular segment just above that corresponding to the display aperture, at approximately 10 o'clock on the dial.

It will be understood from the foregoing that other display alternatives are possible for the grand date display device proposed, with, in particular, a display using symbols whose characters are oriented tangentially and not radially on each of the discs, unlike the preferred embodiments described. Other display variants using other programming and coupling mechanisms between the two display discs are also possible, especially with retractable pivoting teeth that engage radially and not vertically, and for example, concentric display discs formed of a disc and a ring, or even of two non-concentric discs provided with an unequal number of symbols and display segments.

What is claimed is:

1. A grand date calendar display device for a watch movement including a first disc and a second disc, said first and second discs being arranged to display, on certain dates, first date values by combining symbols borne by said first disc and symbols borne by said second disc, and on other dates, second date values by means of symbols borne only by said second disc, wherein said first disc is a modified units display disc, bearing a first series of symbols comprising a first sequence of at most nine first consecutive units numerals, said first series of symbols being truncated by at least a second units numeral with respect to the complete series of ten units, and wherein said second disc is a modified tens display disc comprising a second series of symbols for the display of at least the tens of said date, including at least one combination of two numerals formed of a tens numeral and of said second units numeral.

2. The grand date calendar display device according to claim 1, wherein said first sequence of first units numerals of said first disc is truncated by a second sequence of several second consecutive units numerals starting with the numeral "0" with respect to the complete series of ten units.

3. The calendar display device according to claim 1, wherein said first disc has a first number of at most ten first display segments bearing said first series of symbols.

4. The grand date calendar display device according to claim 3, wherein said first symbols of said first series of symbols and the second symbols of said second series of symbols are regularly distributed respectively on the first display segments of said first disc and second display segments of said second disc.

5. The grand date calendar display device according to claim 4, wherein the first number of the first display segments of said first disc and the second number of the second display segments of said second disc are identical.

6. The grand date calendar display device according to claim 4, each first display segment being associated with the juxtaposition of a first recess followed by a first numeral or another first recess, and each second display segment being associated with the juxtaposition of a tens numeral followed by a second recess or a second units numeral.

7. The grand date calendar display device according to claim 6, wherein the sizes of said first recess, of said second recess, of said tens numeral, of said first units numeral and of said second units numeral are all identical.

8. The grand date calendar display device according to claim 1, wherein said first and second discs are formed by superposed concentric annular elements.

9. The grand date calendar display device according to claim 8, said first disc being formed by an annular element rotating about a holding plate, wherein an element for driving the second disc is arranged on said first disc, and wherein a fixed gear sector is arranged on said holding plate, said drive element for the second disc cooperating, at least on certain dates, with said fixed gear sector in order to drive said second disc.

10. The grand date calendar display device according to claim 1, wherein each of the first and second discs respectively has a first and a second main daily gear toothing selectively meshing with a 24-hour drive wheel according to the date.

11. The grand date calendar display device according to claim 10, wherein each of the first and second discs further respectively has a first and a second additional correction toothing, respectively arranged in a third and a fourth gear plane distinct from first and second gear planes of said first and second main toothings.

* * * * *